United States Patent [19]

Harris

[11] Patent Number: 4,677,929

[45] Date of Patent: Jul. 7, 1987

[54] DESICCANT CARTRIDGE FOR FUEL TANK VENT LINE

[76] Inventor: William B. Harris, 3222 Orangewood Ave., Los Alamitos, Calif. 90720

[21] Appl. No.: 834,405

[22] Filed: Feb. 28, 1986

[51] Int. Cl.[4] ..... B63J 2/00

[52] U.S. Cl. ..... 114/211; 440/88

[58] Field of Search ..... 114/211, 212; 220/204; 55/310, 387, 388; 440/88

[56] References Cited

U.S. PATENT DOCUMENTS

| | | | |
|---|---|---|---|
| 4,266,568 | 5/1981 | Kuybendall | 220/204 X |
| 4,353,318 | 10/1982 | Williams | 114/211 |
| 4,504,289 | 3/1985 | Waller | 55/387 X |

*Primary Examiner*—Sherman D. Basinger

*Attorney, Agent, or Firm*—Michael, Best & Friedrich

[57] ABSTRACT

A desiccant container is removably connected to the vent line of a fuel tank of a boat or the like to prevent accumulation of moisture in the fuel tank.

7 Claims, 2 Drawing Figures

DESICCANT CARTRIDGE FOR FUEL TANK VENT LINE

FIELD OF THE INVENTION

The invention relates to fuel tanks of the type which are fixed in place in a housing such as fuel tanks housed in the hull of a boat and wherein a vent line is provided to vent the fuel tank to the atmosphere outside of the housing.

BACKGROUND PRIOR ART

All fixed fuel tanks, such as those commonly used in boats and wherein the fuel tank is housed in the hull of the boat, commonly include a vent conduit or vent line providing a means for venting the fuel tank to the atmosphere outside of the boat hull. The vent line permits air to be pulled into the tank when the fuel in the tank is consumed and permits air in the tank to be exhausted to the atmosphere when the tank is filled or when there is expansion of the volume of the fluids contained in the fuel tank. In the prior art arrangements such as those where a fuel tank is housed in a boat hull, the vent line provides an open passage between the outside of the boat hull and the fuel tank. As fuel in the tank is consumed, air having a high moisture content is drawn into the fuel tank through the vent line. The moisture may condense in the fuel tank and result in accumulation of water in the fuel tank.

SUMMARY OF THE INVENTION

The present invention comprises an apparatus for use in a fuel tank vent line for removing moisture from air entering the fuel tank through the vent line and for thereby preventing accumulation of condensation in the fuel tank.

More particularly, the invention includes a container adapted to house a desiccant and means for connecting the container to the vent line such that any air flowing through the vent line and into the fuel tank will first flow through the container whereby desiccant in the container will remove moisture from the air. The apparatus embodying the invention also includes a means for controlling air flow into the vent lines such that air exhausted from the tank through the vent line will bypass the desiccant container, and any air flowing through the vent line into the fuel tank must first pass through the desiccant container whereby moisture in the air will be removed by the desiccant.

In one embodiment of the invention the means for controlling air flow through the vent line includes a connector for removably connecting the desiccant container to the vent line. The connector includes a first portion having a check valve and providing for air flow from the atmospere through the desiccant container into the vent line and preventing air flow from the vent line into the desiccant container. The connector also includes a second portion connecting the vent line to the check valve preventing air flow from the atmosphere into the vent line but permitting air flow from the vent line to the atmosphere.

In one embodiment of the invention the desiccant container is adapted to be threaded onto the connector and is relatively thin walled and manufactured from a flexible material easily punctured by a sharp instrument whereby holes can be made in the container to permit air flow into the desiccant container to the vent lines. Additionally, in a preferred form of the invention, the desiccant contaier will comprise a cartridge which is easily attached to the connector and one which is readily accessible so that the desiccant container can be easily replaced when the desiccant in the container is exhausted.

Various other features and advantages of the invention will be apparent by reference to the following description of a preferred embodiment, from the drawings and from the claims.

Figure 1:
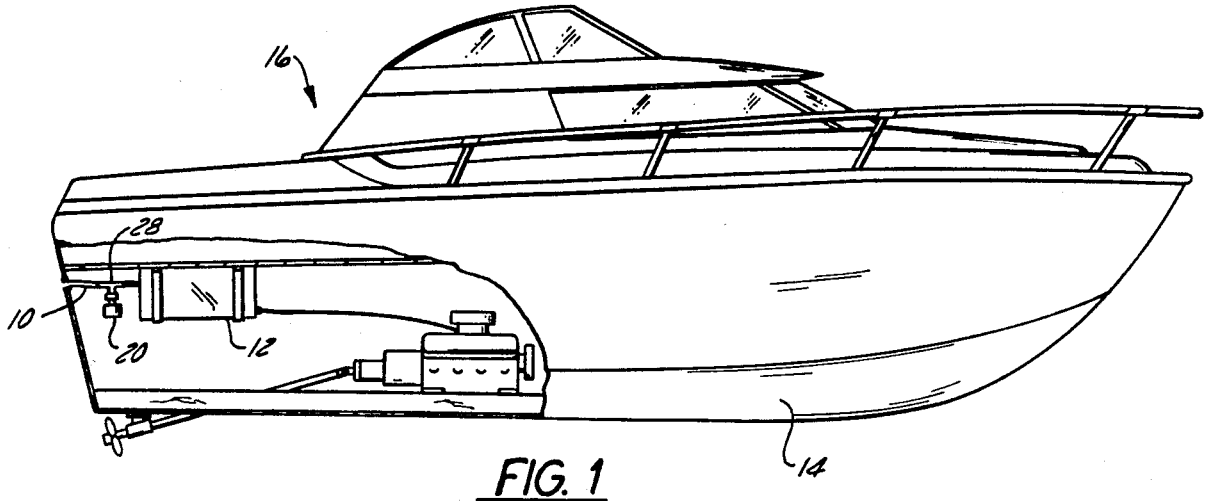
FIG. 1 is an elevation view of an apparatus embodying the invention and included in a vent line of a fuel tank.
Figure 2:
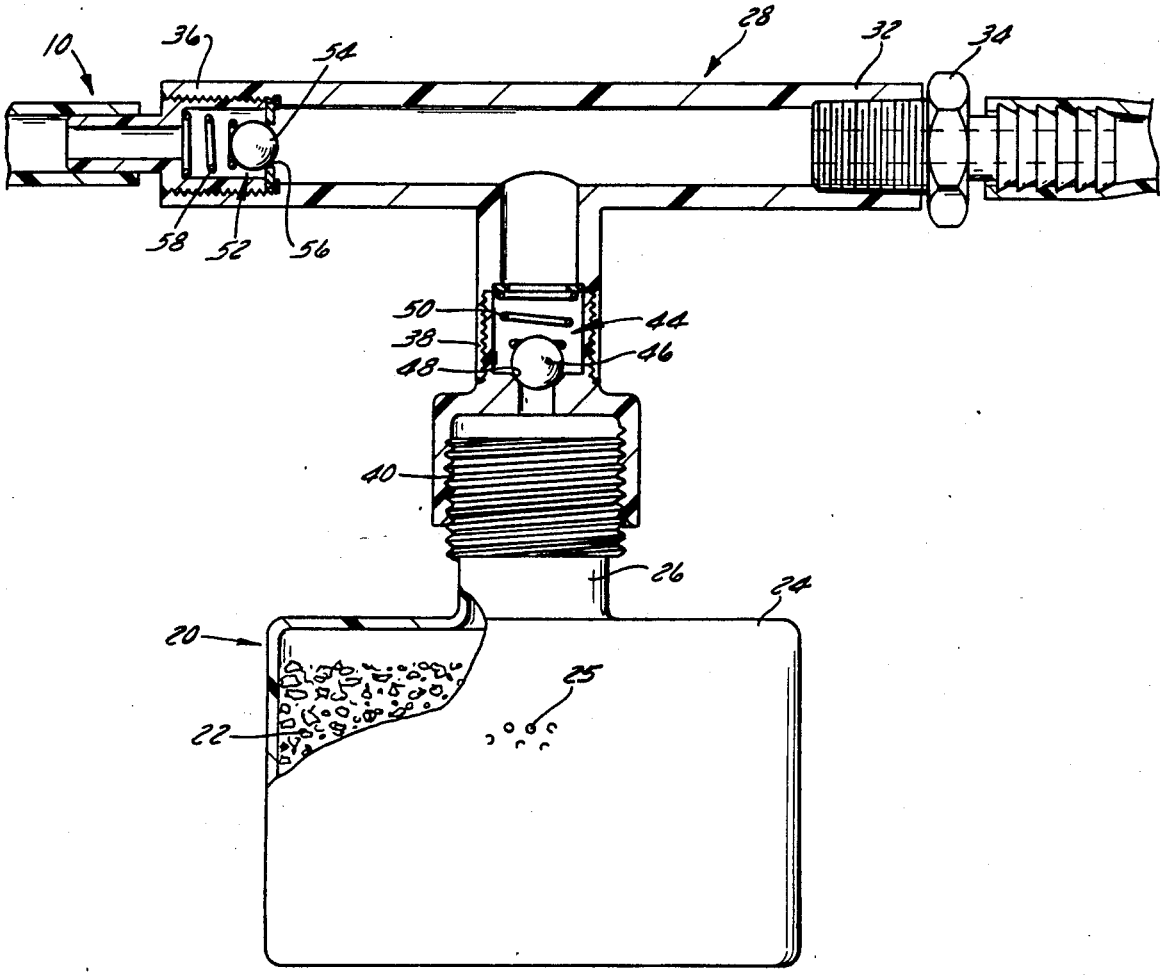
FIG. 2 is an enlarged illustration of the apparatus illustrated in FIG. 1 for removing moisture from air flowing into the vent line of a fuel tank.

Before describing at least one embodiment of the invention in detail, it is to be understood that the invention is not limited in its application to the details of construction and to the specific arrangement set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a vent line 10 connecting a fuel tank 12 housed within the hull 14 of a boat 16 to the atmosphere at a location outside of the boat hull. Fuel tanks including vent lines are commonly included in any boat having an inboard engine as well as in a variety of other types of vehicles wherein an engine is mounted within a fixed housing and wherein it is necessary to vent the fuel tank to the atmosphere outwardly of the housing. The vent line, such as vent line 10, is intended to permit exhaust of air from the fuel tank to the exterior of the boat hull when the fuel tank is filled or when the fluid in the fuel tank expands and also to permit air to be drawn into the fuel tank as the fuel is drawn out of the fuel tank.

Means are also provided for connecting a desiccant container 20 to the vent line 10 such that when air is drawn into the fuel tank 12 through the vent line 10, the air is first drawn through the desiccant container 20 before the air flows into the vent line 10. As the air moves through the desiccant container 20, the desiccant 22 therein will function to remove any moisture in the air in the container. The air flowing from the container 20 through the vent line 10 to the fuel tank 12 will then have a relatively low moisture content thereby minimizing accumulation of condensation in the fuel tank 12.

In one embodiment of the invention, the desiccant container 20 can conveniently comprise a cartridge constructed from a relatively thin walled plastic bottle 24 having a threaded neck 26, to permit the cartridge to be conveniently threadably connected to the vent line. The container can house any convenient commercially available desiccant 22. For purposes of example, a suitable desiccant is calcium chloride. Holes 25 can be punched in the container 20 to permit air flow into the container.

Means are also provided for removably connecting the desiccant container or cartridge 20 to the vent line 10. In the illustrated arrangement this means includes a T-shaped connector 28 having an elongated tubualr portion 30 with one extending end 32 adapted to be connected to that portion of the vent line 10 connected to the fuel tank. The end 32 of the connector can be conveniently joined to the vent line 10 by a conventional coupling 34. The opposite end 36 of the elongated tubular portion 30 of the T-shaped connector is joined to that portion of the vent line 10 extending to the atmosphere outside of the boat hull. The connector also includes a third portion 38 including an internally threaded collar or socket 40 adapted to threadably house the threaded neck 26 of the desiccant container 20 to facilitate attachment and removal of the desiccant container.

It should be understood that in other embodiments of the invention, the desiccant container 24 could have other configurations and could be connected to the vent line 10 in other ways. In a preferred form of the invention, however, the desiccant container will be readibly accessible and easily removed so as to facilitate replacement of the desiccant container with a new desiccant container after the desiccant in the original desiccant container becomes exhausted.

The connector 28 also includes means for selectively permitting air flow through the desiccant container 20 into the vent line 10 while preventing reverse air flow from the vent line 10 through the desiccant container. In the illustrated construction, this means comprises a check valve 44 included in the portion 38 or the connector. The check valve 44 includes a ball 46 biased into engagement with a valve seat 48 by a compression spring 50.

The connector 28 also includes means for selectively permitting air flow from the vent line 10 to atmosphere while prohibiting air flow from the atmosphere into the vent line. In the illustrated construction this means comprises a second check valve 52 housed in the end 36 of the connector 28 joined to the portion of the vent line extending to the atmosphere. In the specific arrangement shown, the check valve 52 includes a ball 54 resiliently biased into engagement with a valve seat 56 by a compression spring 58.

In a preferred form of the invention, the spring 50 will apply a relatively small force on the ball such that only a small negative pressure in the fuel tank 12 is required to accomplish air flow through the desiccant container 20 into the fuel tank 12. Similarly, the spring 58 applies only a small force on the ball 54 of the other check valve 52, and only a relatively small pressure in the fuel tank 12 is sufficient to force the ball 54 away from the valve seat 56 and permit gasses in the fuel tank 12 to be vented through the vent line 10 to the atmosphere.

Various features of the invention are set forth in the following claims:

1. Apparatus for use in a boat having a fuel tank and a vent line connected to the fuel tank for permitting air to enter the fuel tank as fuel is removed from the tank and for permitting air to be exhausted from the fuel tank when the air pressure in the fuel tank exceeds the air pressure of the surrounding atmosphere, the apparatus comprising:

a first check valve providing for air flow from the fuel tank through the vent line to atmosphere and preventing air flow into the fuel tank through the vent line, means for selectively providing for air flow through the vent line into the fuel tank when the pressure of the atmosphere is greater than the pressure in the fuel tank, the means for selectively providing for air flow through the vent line into the fuel tank including a second check valve, and means for removing moisture from the air drawn through the second check valve into the vent line and into the fuel tank, the means for removing moisture including a container connected to the second check valve and a desiccant housed in the container for removing moisture from air drawn through the container and through the second check valve to the fuel tank and means for removably connecting said container to said vent line, said means for removably connecting including a connector having a first portion adapted to be connected to a portion of said vent line communicating with said fuel tank, a second portion adapted to be connected to said container, said second portion housing said second check valve, and a third portion adapted to be connected to a portion of said vent line communicating with the atmosphere, said third portion of said connector housing said first check valve.

2. Apparatus as set forth in claim 1 wherein said container comprises a thin walled plastic container having a threaded portion adapted to be threadably connected to said second portion of said connector.

3. Apparatus for use with a boat having a fuel tank and a vent line having opposite ends and connected to the fuel tank for permitting air to be exhausted from the fuel tank and for permitting air to enter the fuel tank as fuel is removed from the tank, the apparatus comprising:

means for removing moisture from the air drawn through the vent line into the fuel tank, the means for removing moisture including a container connected to the vent line between its opposite ends, a desiccant housed in the container for removing moisture from air drawn through the container and through the vent line to the fuel tank, and means for removably connecting said container to said vent line, said means for removably connecting including a connector having a first portion adapted to be connected to a portion of said vent line communicating with said fuel tank, and said connector including a second portion adapted to be connected to said container, and a third portion adapted to be connected to a portion of said vent line communicating with the atmosphere.

4. Apparatus as set forth in claim 3 wherein said container comprises a thin walled plastic container having a threaded portion adapted to be threadably connected to said second portion of said connector.

5. Apparatus as set forth in claim 3 wherein said second portion of said connector houses a first check valve, said first check valve providing for selective air flow from said container into said vent line when the air pressure of the atmosphere surrounding the fuel tank is greater than the air pressure in the fuel tank and preventing air flow from said vent line into said container and wherein said third portion of said connector houses a second check valve, said second check valve providing for selective air flow from said vent line to atmosphere when the air pressure in the fuel tank exceeds the air pressure of the surrounding atmosphere and preventing air flow from the atmosphere into said vent line.

6. A boat comprising:

a hull, an engine supported by the hull, a fuel tank mounted in the hull, a vent line having one end connected to the fuel tank and an opposite end opening outside the hull, the vent line permitting air to enter the fuel tank as fuel is removed from the tank and permitting air to be exhausted from the tank when the pressure in the tank increases, first check valve means providing for air flow from the fuel tank through the vent line to atmosphere and preventing air flow into the fuel tank through the vent line, means for removing moisture from the air drawn through the vent line into the fuel tank, the means for removing moisture including a container connected to the vent line, and a desiccant housed in the container for removing moisture from the air drawn through the container and through the vent line to the fuel tank, and means for removably connecting the container to the vent line between the fuel tank and the first check valve means, said means for removably connecting including a connector having a first portion connected to a portion of said vent line communicating with said fuel tank, a second portion connected to said container, said second portion housing a second check valve means for providing for air flow from said container to said vent lien while preventing air flow from said vent line into said container, and a third portion connected to a portion of said vent line communicating with the atmosphere, said third portion of said connector housing said first check valve means providing for airflow of air from the fuel tank through the vent line to the atmosphere.

7. A boat as set forth in claim 6 wherein said a thin walled plastic container having a threaded portion adapted to be threadably connected to said second portion of said connector.

* * * * *